United States Patent [19]

Müller

[11] Patent Number: 4,831,750

[45] Date of Patent: May 23, 1989

[54] SHOE-CONSTRUCTION SHOE-CONSTRUCTION PRODUCT AND METHOD OF FABRICATING THE PRODUCT

[76] Inventor: Hubert Müller, Uferstrasse 44, D-4902 Bad Salzuflen 1, Fed. Rep. of Germany

[21] Appl. No.: 662,400

[22] Filed: Oct. 18, 1984

[30] Foreign Application Priority Data

Oct. 22, 1983 [DE] Fed. Rep. of Germany ... 8331925[U]

[51] Int. Cl.[4] ..... A43B 13/12

[52] U.S. Cl. ..... 36/28; 36/30 R

[58] Field of Search ..... 36/30 R, 32 R, 33, 114, 36/91, 25 R, 28

[56] References Cited

U.S. PATENT DOCUMENTS

| | | | |
|---|---|---|---|
| 2,448,663 | 9/1948 | Diamant | 36/30 R |
| 3,589,036 | 6/1971 | Hendricks | 36/32 R |
| 3,613,272 | 10/1971 | Fukuoka | 36/91 |
| 4,030,213 | 6/1977 | Daswick | 36/114 |
| 4,069,601 | 1/1978 | Robbins et al. | 36/30 R |
| 4,316,332 | 2/1982 | Giese et al. | 36/30 R |
| 4,372,059 | 2/1983 | Ambrose | 36/30 R |
| 4,377,041 | 3/1983 | Alchermes | 36/30 R |
| 4,399,620 | 8/1983 | Funck | 36/30 R |
| 4,413,429 | 11/1983 | Power | 36/30 R |
| 4,524,529 | 7/1985 | Schaefer | 36/30 R |

FOREIGN PATENT DOCUMENTS

| | | | |
|---|---|---|---|
| 1156458 | 6/1969 | United Kingdom | 36/30 R |

*Primary Examiner*—Werner H. Schroeder

*Attorney, Agent, or Firm*—Workman, Nydegger & Jensen

[57] ABSTRACT

A shoe foundation in which a shoe support is formed by several superimposed layers mutually connected to one another includes a base layer of rubber-bound cork, an elastic support layer of foamed material disposed on the base layer, and a cover layer of leather or the like disposed on the support layer, and wherein the layers are interconnected into a unit free of any adhesive means.

7 Claims, 1 Drawing Sheet

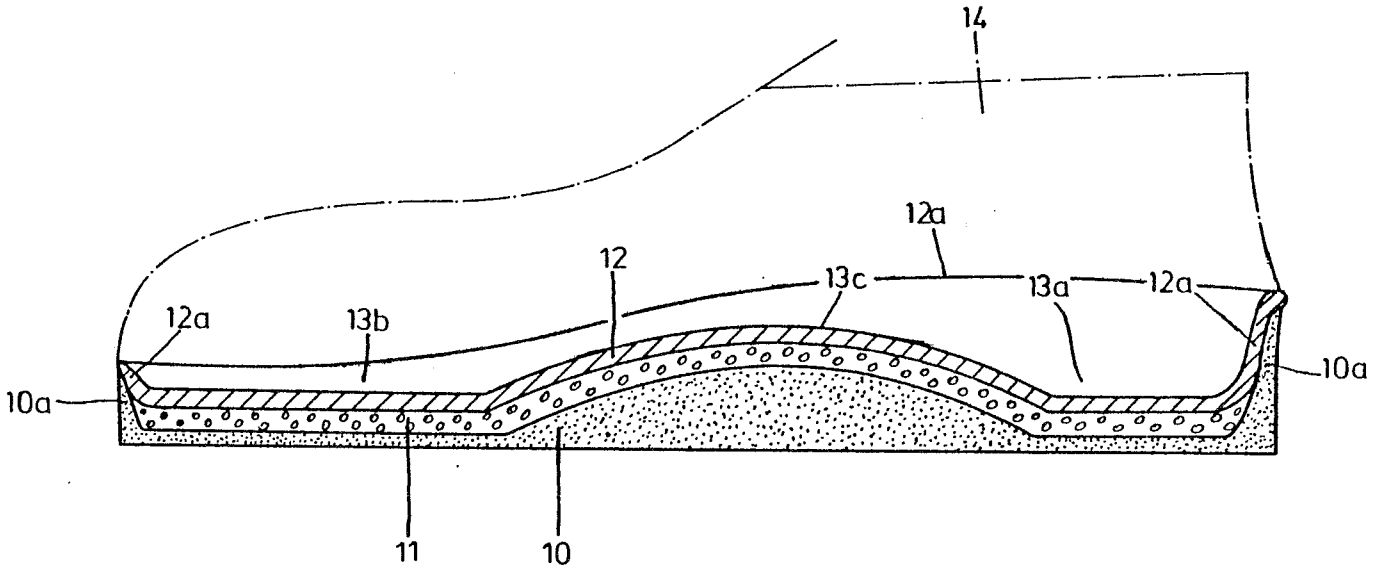
10a
12a
13a
14
12a
13c
12
10
11
13b
12a
10a

SHOE-CONSTRUCTION SHOE-CONSTRUCTION PRODUCT AND METHOD OF FABRICATING THE PRODUCT

BACKGROUND OF THE INVENTION

The invention relates to a shoe foundation or shoe construction product, including a foot support, which consists of several superimposed layers connected to one another.

Shoe supports of this type have hitherto been manufactured in a work-consuming and time-consuming manner by shaping the individual layers and subsequently glueing the layers to one another, which requires several operating steps, which have a disadvantageous effect on the manufacturing costs.

SUMMARY OF THE INVENTION

It is an object of the invention to improve a shoe foundation of the aforedescribed type in such a manner that it is composed of layers, which permit a simple and cost-effective manufacture in one operating step, while nevertheless concurrently ensuring an implementation which wears well and is of a high quality.

This object is attained, according to the invention, by providing several superimposed layers mutually connected to one another, including a base layer of rubber-bound cork, an elastic support layer disposed on the base layer, and a cover layer of leather or the like disposed on the elastic support layer, and interconnecting the layers into a unit free of any adhesive means.

The object of the invention covers not only the features of the individual appended claims, but also their combination.

The inventive shoe foundation consists of three layers, which are combined into a single unit during manufacture free of any adhesive means. The three layers are formed by a base or running layer of rubber-bound cork, an elastic intermediate support layer of foamed material disposed on the base layer, and a cover layer of leather, in turn disposed on the elastic support layer, and wherein the layers are connected directly through the foamed intermediate layer without the use of any additional adhesive means.

In this manner manufacture of the shoe foundation in one step in a mold through pressure- and heat-action is rendered possible so as to be simple, rational, and cost-effective.

The base or running layer includes a peripheral, and upwardly extending rim, whose upper edge merges with the cover layer. Consequently the elastic intermediate layer is embedded between the base layer and the cover layer so as to be closed off from the exterior; and entire shoe foundation is consequently made wear-resistant and formed so as to be secured against being indented, which, in turn, has an extremely favorable effect on its durability and life.

Furthermore, the shoe foundation is simultaneously formed during manufacture into a foot support, so that any preliminary deformation for rendering it suitable for a foot support is not required.

Due to the running- or base layer in the wear-resistant implementation, and the embedded elastic intermediate support a very good support surface, as well as a soft and agreeable property of the foot foundation has been created, which is comfortable for walking and running.

The rim of the base- or running layer near the heel is drawn upwardly higher than the corresponding rim of the base- or running layer near the toes, so that the heel is consequently completely surrounded, and, instead of an effective point load a distributed surface load is created with respect to the entire heel region.

Due to the employment of particular layers, the favorable method of manufacture, providing a comfortable foot support for walking and running, and yet security, the subject of the invention has received a high degree of usage and manifold employment for most different types of shoes.

BRIEF DESCRIPTION OF THE DRAWING

For a fuller understanding of the nature and objects of the invention, reference should be had to the following detailed description, taken in connection with the sole FIGURE of the drawing, which is a longitudinal section through the inventive shoe foundation.

DESCRIPTION OF THE PREFERRED EMBODIMENTS

The shoe foundation, namely the entire sole, consists, according to the invention, of three layers, namely a base- or running layer 10 of rubber-bound cork namely cork including rubber as binding means, an elastic intermediate layer 11 disposed thereabove made of foamed (blown-up) material, and a cover layer 12 disposed, in turn, thereabove made of leather, artificial leather or the like, and wherein these three layers 10, 11 and 12 are connected to one another during manufacture into a single unit, without using any adhesives.

The running- or base layer 10 is formed to be substantially flat on its underside, which forms the running surface, while all three layers 10, 11, and 12 form together a foot bed on the upper side, which is recessed in the region of the heel **13*a*, and in the region of the toes 13*b*, and includes an upwardly pointing arcuate foot support 13*c*** therebetween.

The running- or base layer 10 is formed with a continuous rim **10*a* extending upwardly, and which merges at the upper side with the rim 12*a* of the cover layer 12; there both rims 10*a* and 12*a* are connected by means of the intermediate layer 11, which, in turn, is embedded between the layers 10 and 12**.

The running- or base layer 10 has a thickness in the heel- and toe regions **13*a* and 13*b* which is smaller than the thickness of the intermediate layer 11, but exceeds that of the cover layer 12. The level or height of the upwardly extending portion of the rim 10*a* of the running- or base layer 10 exceeds, at least at the rear portion of the foot foundation, that of the level or height of the arcuate foot support 13*c***.

The level or height of the peripherally extending rim **10*a* of the running- or base layer 10 is greater in the heel region 13*a* than the toe region 13*b*, and, as had already been stated, is also greater there than the level or height of the arcuate foot support 13*c***.

Along one foot-supporting longitudinal side of the foot-foundation the level of the rim **10*a* of the running- or base layer 10 exceeds that of the opposite longitudinal side, and also projects beyond that of the region of the foot support 13*c*, so that the foot is circumferentially firmly surrounded by the rim 10*a* in conjunction with the rim 12*a*** of the cover layer.

The arcuate foot support **13*c* is formed by material accumulation of the running- or base layer 10, and the intermediate support 11 and the cover layer 12** are formed at respective equal thicknesses in a corresponding arcuate manner.

The elastic intermediate support 11 consists preferably of rubber or similar synthetic material.

Manufacture of the inventive shoe foundation is made in molds, into which the materials of the three layers 10, 11 and 12 are inserted in precisely determined proportions at appropriate respective positions. The individual layers are then connected by a pressure- and heat-effect, and wherein shaping of the foundation with the foot bed or foot support 13*a*, 13*b* and 13*c*, and the connection of the layers 10, 11 and 12 through the foamable intermediate support 11, which, so to speak, may be blown up, is accomplished during manufacture so as to be free of any adhesives.

The foundation may be used for most different types of shoes, sandals, slippers, or the like, and is secured in a suitable manner to the foundation of the upper part 14 of the shoe.

I wish it to be understood that I do not desire to be limited to the exact details of construction shown and described, for obvious modifications will occur to a person skilled in the art.

Having thus described the invention, what I claim as new and desire to be secured by Letters Patent, is as follows:

1. A shoe-construction product comprising a shoe support resulting from the process of (a) superimposing a base layer of cork, including rubber as a binding material, an elastic support layer, and a cover layer of leather-like material, so that the support layer is disposed on said base layer, and the cover layer is disposed on said support layer, and (b) interconnecting said layers into a unit free of any adhesive means in a single operating step, wherein said process further comprises the steps of forming said base layer on a lower side thereof with an almost flat running surface, and with an upwardly extending base-layer rim, forming said cover layer with an upwardly extending cover-layer rim, embedding said elastic support layer between said base layer and said cover layer, and merging said rims so as to close off said elastic support layer from the exterior, whereby said elastic support layer is secured against being indented, and the shoe product is made wear-resistant.

2. The shoe-construction product as claimed in claim 1, wherein said shoe support has a heel region and a toe region, and wherein said process further comprises the steps of forming said base layer with a thickness in said heel region and in said toe region smaller than the thickness of said elastic support layer, but exceeding that of said cover layer.

3. The shoe-construction product as claimed in claim 1, wherein said process further includes the steps of forming said shoe support during its manufacture into a convexly and upwardly curved foot support, surrounding the entire base layer with said upwardly extending base layer rim, and drawing the height of said upwardly extending base layer rim at least in a longitudinal region and in a heel region of said foot support so as to exceed that of said foot support.

4. The shoe-construction product as claimed in claim 3, wherein said process further includes the step of drawing the height of said upwardly extending base layer rim higher in said heel region than in said toe region.

5. The shoe-construction product as claimed in claim 3, wherein said shoe support has a heel region and a toe region, and wherein said process includes the step of shaping said base layer material in a foot support region intermediate said heel region and said toe region so as to be convexly curved upwardly.

6. A shoe-construction comprising, in combination, an upwardly curved, convex shoe support, a base layer of cork including rubber as binding means, an elastic support layer disposed on said base layer, and a cover layer of leather-like material disposed on said support layer, said layers being interconnected into a unit free of any adhesive means, said base layer having a lower side, said lower side having an almost flat running surface, a first upwardly extending rim surrounding said base layer, said cover layer having a second upwardly extending rim merging with said first upwardly extending rim in an upward location, said elastic support being embedded between said base layer and said cover layer, thereby securing said elastic layer against being indented, and making said shoe-construction product wear-resistant, said shoe support defining a heel region and a toe region, and wherein said base layer has thickness in said heel region and in said toe region smaller than that of said elastic support layer, but exceeding that of said cover layer, said first upwardly extending rim having a height at least in a longitudinal region and in said heel region of said foot support which exceeds that of said foot support, while its height in said heel region exceeds its height in said toe region.

7. A method of making a shoe construction, comprising a shoe support defining a heel region and a toe region, a base layer of cork material, including rubber material as binding means, an elastic support layer disposed on said base layer, and a cover layer of leather-like material disposed on said support layer, the method comprising the steps of:

selecting said elastic support layer from a foamable material, interconnecting said layers into a unit free of any adhesive means in a single operating step, by inserting materials of said layers in precisely determined respective proportions and positions into a mold under pressure and heat, forming said base layer on a lower side thereof with an almost flat running surface, and with an upwardly extending base-layer rim, so as surround the entire base layer with said upwardly extending base-layer rim, forming said cover layer with an upwardly extending cover-layer rim, embedding said elastic support layer between said base layer and said cover layer, merging said rims so as to close off said elastic support layer from the exterior, thereby securing said elastic support layer against being indented, and making the shoe-construction product wear-resistant, forming said base layer with a thickness in said heel region and in said toe region smaller than the thickness of said elastic support layer, but exceeding that of said cover layer, shaping said base layer material in a foot support region intermediate said heel region and said toe region so as to be convexly curved upwardly, drawing the height of said upwardly extending base layer rim at least in a longitudinal region and in said heel region of said foot support so as to exceed that of said foot support, while drawing the height of said upwardly extending base layer rim higher in said heel region than in said toe region.

* * * * *